US005797438A

United States Patent [19]

Dye

[11] Patent Number: 5,797,438

[45] Date of Patent: Aug. 25, 1998

[54] TOOTHED ROLLER

[75] Inventor: Stanley E. Dye, Latah, Wash.

[73] Assignee: Denharco Inc., St. Hyacinthe, Canada

[21] Appl. No.: 855,398

[22] Filed: May 13, 1997

[51] Int. Cl.[6] ..... B27B 31/00

[52] U.S. Cl. ..... 144/246.1; 144/242.1; 144/248.5; 144/248.6; 144/250.1; 198/780

[58] Field of Search ..... 198/834, 835, 198/494, 780, 781.1; 144/208.1, 208.4, 208.8, 242.1, 246.1, 248.4, 248.5, 248.6, 247, 250.1, 246.2

[56] References Cited

U.S. PATENT DOCUMENTS 4,385,650 5/1983 Schmidt ..... 144/248.5

4,603,718 8/1986 Hutson ..... 144/246.1

*Primary Examiner*—W. Donald Bray

[57] ABSTRACT

A toothed roller having a cylindrical body with circumferential rows of teeth fixed on the outer surface of the body. The rows of teeth are longitudinally spaced apart on the body. A cleaning ring is loosely mounted on the body between each adjacent pair of rows of teeth. Each cleaning ring has an inner diameter slightly larger than the outer diameter of the body and an outer diameter slightly smaller than the outer diameter of a row of teeth whereby when one portion of the cleaning ring abuts the body, the diametrically opposed portion of the ring is nearly level with the ends of the teeth so as to be able to push out material and debris caught between, and on, the rows of teeth.

12 Claims, 2 Drawing Sheets

Fig. 1
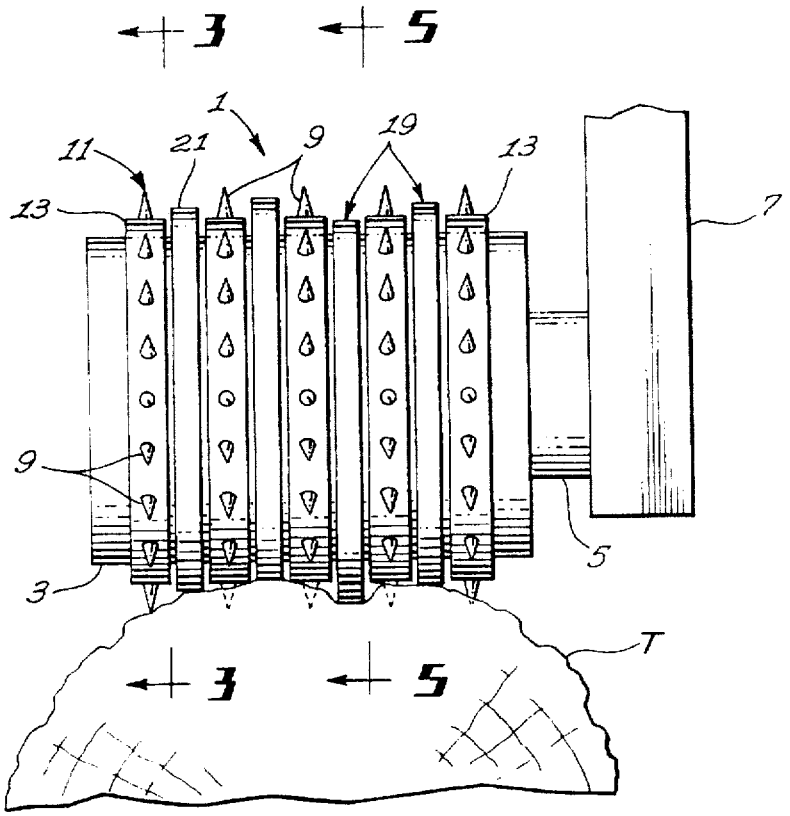
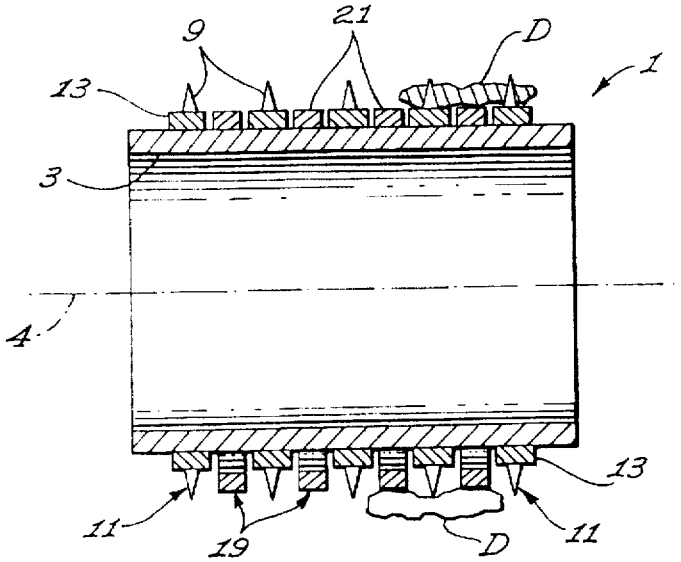
Fig. 2

TOOTHED ROLLER

BACKGROUND OF THE INVENTION

1. Field of the Invention

This invention is directed toward a new toothed roller. The invention is more particularly directed toward a new toothed roller used in conjunction with processing cut trees during tree harvesting operations. The invention is particularly directed toward a new, self cleaning, toothed roller used in conjunction with processing cut trees.

2. Description of the Related Art Including Information Disclosed Under CFR §§ 1.97–1.99

Tree delimbers and tree harvesters employ toothed rollers to feed trees during delimbing and/or harvesting. The feed rollers are generally cylindrical in shape and rotatable about an axis that extends transverse to the longitudinal axis of the tree being fed by the roller. Hydraulic motors rotate the rollers to feed the trees.

The feed rollers have teeth on their outer surface to bite into the surface of the tree to ensure feeding of the tree. The teeth on the known feed rollers often become clogged with bits and pieces, such as bark, off the tree. The tree debris can prevent the teeth from biting deeply into the tree and slippage of the feed roller on the tree can occur because of the clogging debris. If slippage occurs, tree feeding is uneven and slows down.

Toothed rollers can also be combined with measuring means to provide a measuring roller to measure the length of the tree being fed past the roller. The measurement is important when cutting the tree length into sections of desired length for example. These measuring rollers can also slip when they become clogged with tree debris such as bark resulting in inaccurate measurements.

The problem of clogging by tree debris can be overcome by stopping the operation of the machine employing the toothed roller and manually cleaning the roller of accumulated tree debris but this of course slows down the operation being performed by the machine.

SUMMARY OF THE INVENTION

It is the purpose of the present invention to provide a toothed roller that minimizes clogging of the teeth on the roller with tree debris such as bark.

In accordance with the present invention a toothed roller is provided having cleaning means on the roller for pushing out material that might accumulate on and/or between the teeth on the roller. The roller is self cleaning. The roller is preferably arranged with the teeth on the roller in circumferential rows about the cylindrical body of the roller. The cleaning means preferably comprise annular cleaning rings rotatably mounted between the rows of teeth. The cleaning rings are sized to be moved radially outwardly between the rows of teeth on the side of the roller opposite the side contacting the tree during operation of the roller. As the rings are moved outwardly, they push out any debris that may have lodged between, or on, the rows of teeth. Thus the cleaning rings automatically and continually clean the roller of debris during operation of the roller allowing the roller to operate with a minimum of slippage.

The invention is particularly directed toward a toothed roller having a body rotatable about a longitudinal axis. Circumferential rows of teeth are mounted on the outer surface of the body transverse to the longitudinal axis. Cleaning means are mounted on the body to automatically push debris out from between the rows of teeth. The cleaning means are constructed to push the debris out from between the rows of teeth on the side of the body opposite the side of the body adjacent a tree traversing the roller.

BRIEF DESCRIPTION OF THE DRAWINGS

FIG. 1 is an end view of the roller contacting a tree;

FIG. 2 is a longitudinal cross-section view of the roller;

DESCRIPTION OF THE PREFERRED EMBODIMENTS

Figure 3:
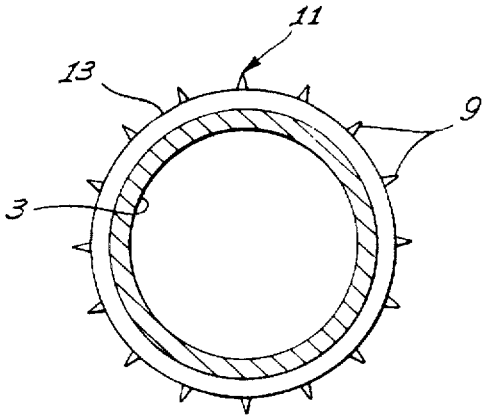
FIG. 3 is a cross section view taken along line 3—3 in FIG. 1.

The toothed roller 1 of the present invention, as shown in FIGS. 1 and 2, has a cylindrical body 3 . The body 3 is mounted for rotation about its longitudinal axis 4 on a suitable axle 5 which is mounted on an arm 7 biasing the roller 1 against a tree T as is well known. The arm 7 is mounted on a tree harvesting machine, a tree delimber machine, or any other similar tree processing machine as is well known. If the toothed roller is a feed roller, a suitable hydraulic motor (not shown) is mounted within the body of the roller for rotating it on the axle 5 to feed the tree as is well known. If the toothed roller is a measuring roller, it can freely rotate on the axle 5 and sensing means (not shown) are provided on the roller for measuring its rotation and converting it into a length measurement as is well known.

Mounted on the outer surface of the body 3 of the roller 1 are radially extending gripping teeth 9 for gripping into the tree T as the roller rotates. The teeth 9 are arranged in circumferential rows 11, the rows 11 extending transverse to the longitudinal axis 4, the teeth in each row being circumferentially spaced apart, as shown in FIG. 3. The rows are generally parallel and longitudinally spaced apart as shown in FIG. 2. The teeth 9 can be directly mounted on the outer surface of the body 3. Preferably however, each row 11 of teeth are formed on an annular ring 13 which in turn is fixedly mounted, by welding, bolts, or other suitable means, on the body 3. The inner diameter of each mounting ring 13 is sized so that the ring just fits onto the body 3. The mounting rings 13, carrying the teeth 9, are mounted on the body 3 in spaced apart relation. Each mounting ring 13 can, in some cases, carry two rows of teeth 9 but in such an arrangement it is obviously harder to clean the teeth.

Figure 4:
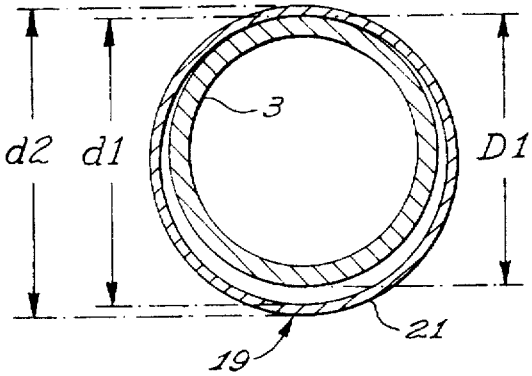
FIG. 4 is a cross section view showing a cleaning ring mounted on the roller body.

The roller 1 carries cleaning means 19 for automatically cleaning out debris D that can collect between and on the teeth 9 as a tree T traverses the roller. The cleaning means 19 comprises annular cleaning rings 21 loosely mounted on the body 3 of the roller 1. One cleaning ring 21 is located between each adjacent pair of rows 11 of teeth 9, or, if the teeth are mounted on mounting rings 13, between each adjacent pair of mounting rings 13. Each cleaning ring 21 is dimensioned to have an inner diameter "d1" that is slightly greater than the outer diameter "D1" of the body 3 as shown in FIG. 4. The outer diameter "d2" of the cleaning ring 21 is slightly less than the outer diameter "D2" of the teeth 9 in a row 11.

Figure 5:
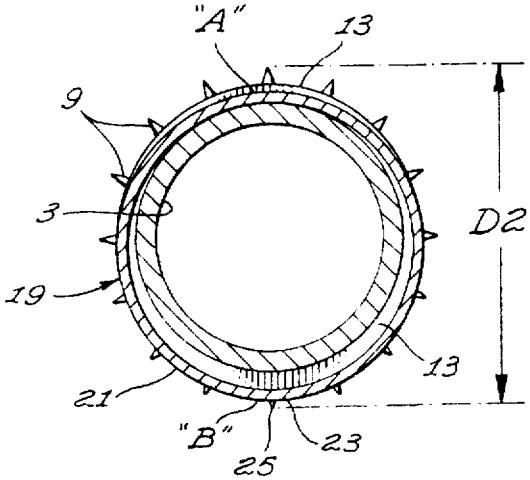
FIG. 5 is a cross section view taken along line 5—5 in FIG. 1.

The size of the cleaning rings 21 relative to the size of the roller body 3 and the outer diameter of the row 11 of teeth 9 is such that as the teeth 9 on one side of the roller body enter the tree, the tree pushes the portion "A" of the cleaning rings 21 on that side of the body toward or against the body as shown in FIG. 5. The portion "B" of the cleaning rings 21, diametrically opposed to the portion "A" of the cleaning rings pushed against the body, are moved radially outwardly away from the body to push out any debris "D" caught between, or on, the teeth 9 to keep the roller clean. The outer surfaces 23 of the portion "B" of the cleaning rings 21 are pushed out nearly to the outer ends 25 of the teeth 9 as shown in FIG. 5. The cleaning process is continual, and automatic, as the roller rotates.

Figure 6:
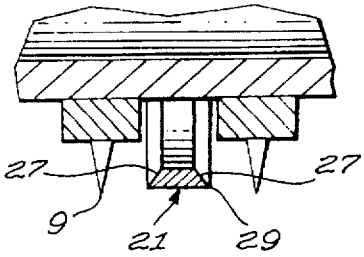
FIG. 6 is a detail cross-section view of a cleaning ring.

If desired, the side edges of each cleaning ring 21 can be beveled as shown at 27 in FIG. 6 to provide cutting edges 29 on the sides of the ring which will cut debris projecting laterally each row of teeth aiding in its removal.

The roller can be assembled by welding the mounting rings onto the main body in longitudinally spaced-apart relationship. Each cleaning ring can each be provided in two halves and the two halves can be welded, bolted or otherwise fixed together about the main body between adjacent rows of teeth.

The roller body is preferably cylindrical in shape and the cleaning rings are all of the same size. The roller body could however have a shape similar to a hyperboloid and in this case the cleaning rings would increase in size from the center of the body toward its ends.

The roller can be mounted for contact on the top or the bottom of the tree traversing the roller. If mounted on the bottom, gravity will aid in moving the cleaning rings outwardly away from the tree to clean the roller. If debris prevents gravity from moving the rings outwardly, the tree itself will move the rings downwardly away from the tree to clear the debris.

I claim:

1. A toothed roller having a main body rotatable about a longitudinal axis; circumferential rows of teeth on the outer surface of the main body, each row extending transverse to the longitudinal axis; and cleaning means mounted on the main body to automatically push debris out from between the rows of teeth when the roller is rotated against an object from which it picks up debris.

2. A toothed roller as claimed in claim 1 wherein the main body is cylindrical.

3. A toothed roller as claimed in claim 1 wherein the cleaning means are constructed to push the debris out from between the rows of teeth on the side of the main body opposite the side of the main body adjacent the object traversing the roller.

4. A toothed roller as claimed in claim 3 wherein the cleaning means comprise annular rings rotatably mounted on the main body, each ring located between adjacent rows of teeth.

5. A toothed roller as claimed in claim 2 wherein the cleaning means are arranged to push the debris out from between the rows of teeth on the side of the main body opposite the side of the main body adjacent the object being traversed by the roller.

6. A toothed roller as claimed in claim 5 wherein the cleaning means comprise annular rings rotatably mounted on the main body, each ring located between adjacent rows of teeth.

7. A toothed roller as claimed in claim 6 wherein each ring has an inner diameter slightly larger than the outer diameter of the body and an outer diameter slightly smaller than the outer diameter of each row of teeth whereby when the portion of the ring adjacent the object traversing the roller is pushed by the object against the body, its diametrically opposite portion is nearly even with the outer portion of the teeth.

8. A toothed roller as claimed in claim 7 wherein the side edges of each cleaning ring are beveled inwardly from the outer edge.

9. A toothed roller having a cylindrical body with circumferential rows of teeth fixed on the outer surface of the body, the rows of teeth longitudinally spaced apart on the body, a cleaning ring loosely mounted on the body between each adjacent pair of rows of teeth, each cleaning ring having an inner diameter slightly larger than the outer diameter of the body and an outer diameter slightly smaller than the outer diameter of a row of teeth whereby when one portion of the cleaning ring abuts the body, the diametrically opposed portion of the ring is nearly level with the ends of the teeth.

10. A toothed roller as claimed in claim 9 wherein the toothed roller is a feed roller, and means are provided for mounting the roller on a tree processing machine for use in feeding a tree.

11. A toothed roller as claimed in claim 9 wherein the toothed roller is a measuring roller, and means are provided for mounting the roller on a tree processing machine for use in measuring a tree.

12. A toothed roller as claimed in claim 9 wherein the side edges of each ring are beveled inwardly from the outer portion of the edge.

* * * * *